United States Patent [19]

Sakaguchi et al.

[11] Patent Number: 5,027,888

[45] Date of Patent: Jul. 2, 1991

[54] METHOD AND APPARATUS FOR SEALING MOLTEN METAL FOR A TWIN-ROLL TYPE CONTINOUS CASTING APPARATUS

[75] Inventors: Haruo Sakaguchi, Osaka; Minoru Tsukigahora, Mino; Shiromitsu Iwatani, Nara; Kunio Nagai, Osaka; Masakazu Mouri, Takatsuki, all of Japan

[73] Assignee: Hitachi Zosen Corporation, Japan

[21] Appl. No.: 466,247

[22] Filed: Jan. 17, 1990

[30] Foreign Application Priority Data

Jan. 31, 1989 [JP] Japan ..... 1-21812
Mar. 15, 1989 [JP] Japan ..... 01-64520

[51] Int. Cl.[5] ..... B22D 11/06

[52] U.S. Cl. ..... 164/480; 164/429; 164/472; 164/268

[58] Field of Search ..... 164/480, 428, 472, 268

[56] References Cited

U.S. PATENT DOCUMENTS 4,811,780 3/1989 Yamauchi et al. ..... 164/480

*Primary Examiner*—Kuang Y. Lin

*Attorney, Agent, or Firm*—Barnes, Kisselle, Raisch, Choate, Whittemore & Hulbert

[57] ABSTRACT

Method and apparatus for sealing molten metal for use in twin-roll type continuous casting apparatus for preventing molten metal from entry into a clearance between a pair of mold rolls and side weirs disposed at opposite ends of the pair of mold rolls to define a molten metal reservoir above the gap between the mold rolls. a sealing medium is supplied at the inner side of the side weirs in the vicinity of the border between the molten metal and each of the mold rolls. Entry of molten metal into the clearance is prevented without the necessity of pressing the side weirs against the roll ends.

21 Claims, 12 Drawing Sheets

METHOD AND APPARATUS FOR SEALING MOLTEN METAL FOR A TWIN-ROLL TYPE CONTINOUS CASTING APPARATUS

FIELD OF THE INVENTION

This invention relates to method and apparatus for sealing molten metal for a twin-roll type continuous casting apparatus.

BACKGROUND OF THE INVENTION

Continuous casting apparatuses of the twin-roll type for casting a thin steel plate have been known in which a pair of mold rolls are employed for drawing slabs through a clearance between the rolls. In such twin-roll type continuous casting apparatus, side weirs are provided at opposite ends of the rolls so as to form a molten metal (molten steel) reservoir above the gap between the two rolls. The side weirs are pressed against the rolls under considerable force in order to prevent any leakage of molten metal.

However, such known arrangement involves a problem that abrasive wear occurs between the rolls and the side weirs with the result that the service life of the side weirs is reduced and that corner portions of the rolls become rounded, the sealing performance of the arrangement being thus adversely affected. Another problem is that both the rolls and the side weirs are inevitably thermally affected so that some gap is produced in the interface between each roll and each side weir, with the result that molten metal enters the gap to produce burrs which would be a cause of inferior slab configuration or breakage of slide portions of the side weir, thus leading to a shutdown in casting operation.

SUMMARY OF THE INVENTION

It is an object of the invention to provide method and device for sealing molten for a twin-roll type continuous casting apparatus which can eliminate the foregoing problems.

In order to accomplish the above objective, according to the invention there is provided a method for sealing molten metal in a twin-roll type continuous casting apparatus for preventing molten metal from entry into a clearance between a pair of mold rolls and side weirs disposed at opposite ends of the pair of mold rolls to define a molten metal reservoir above the gap between the mold rolls, characterized in that a sealing medium is supplied at the inner side of the side weirs in the vicinity of the border between the molten metal and each of the mold rolls.

According to the invention there is also provided an apparatus for sealing molten-metal in a twin-roll type continuous casting apparatus for preventing molten metal from entry into a clearance between a pair of mold rolls and side weirs disposed at opposite ends of the pair of mold rolls to define a molten metal reservoir above the gap between the mold rolls, the apparatus comprising means for supplying a sealing medium at the inner side of the side weirs in the vicinity of the border between the molten metal and each of the mold rolls.

According to such arrangement, the sealing medium enters into the clearance between each end of each of the rolls and the adjacent side gate, so that molten metal or solidified shell is prevented from entering into the clearance without the necessity of the side weir being pressed against the roll end.

DESCRIPTION OF THE PREFERRED EMBODIMENTS

First Embodiment

Figure 1:
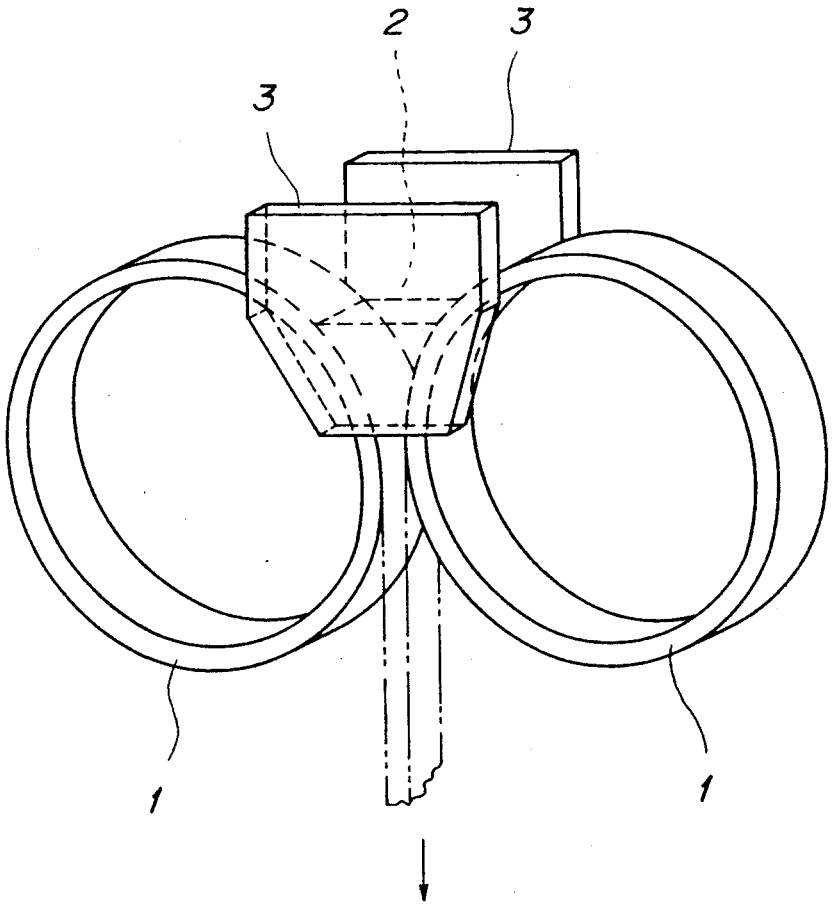
FIG. 1 is a perspective view showing a schematic general arrangement of a first embodiment of the apparatus for sealing molten metal according to the invention.
Figure 2:
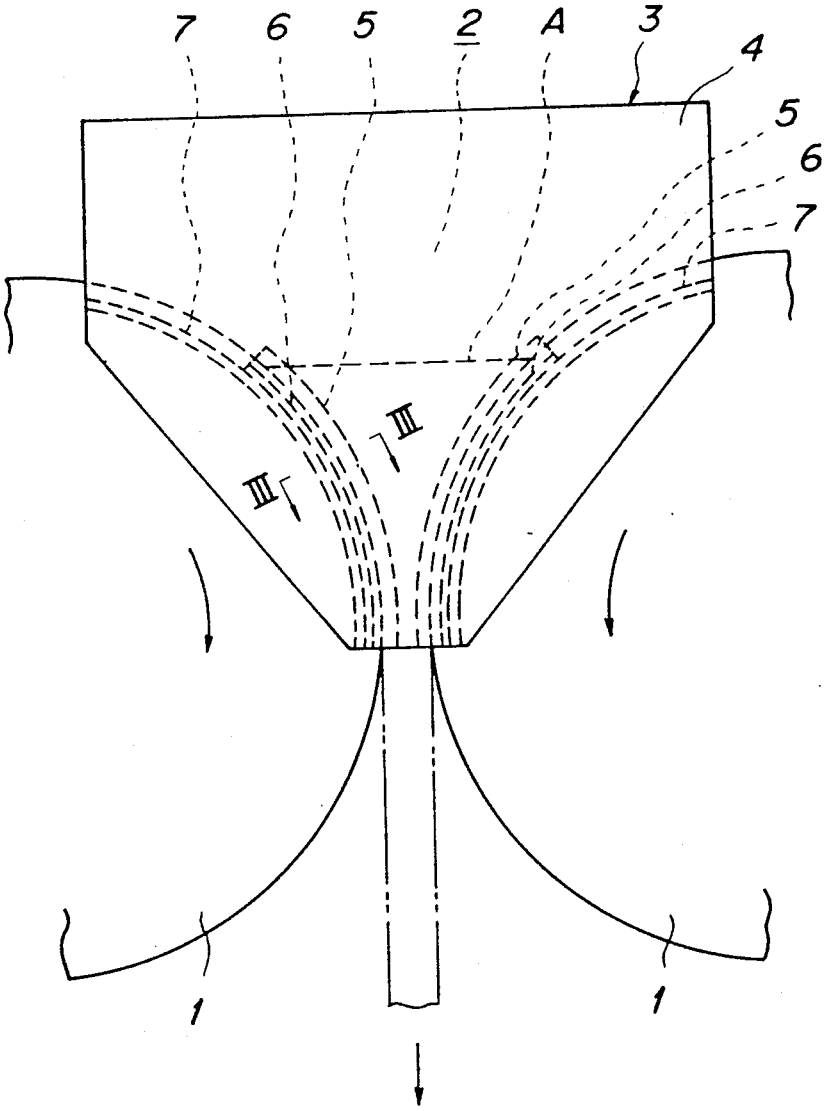
FIG. 2 is a front view of a side weir and its vicinity show in FIG. 1.
Figure 3:
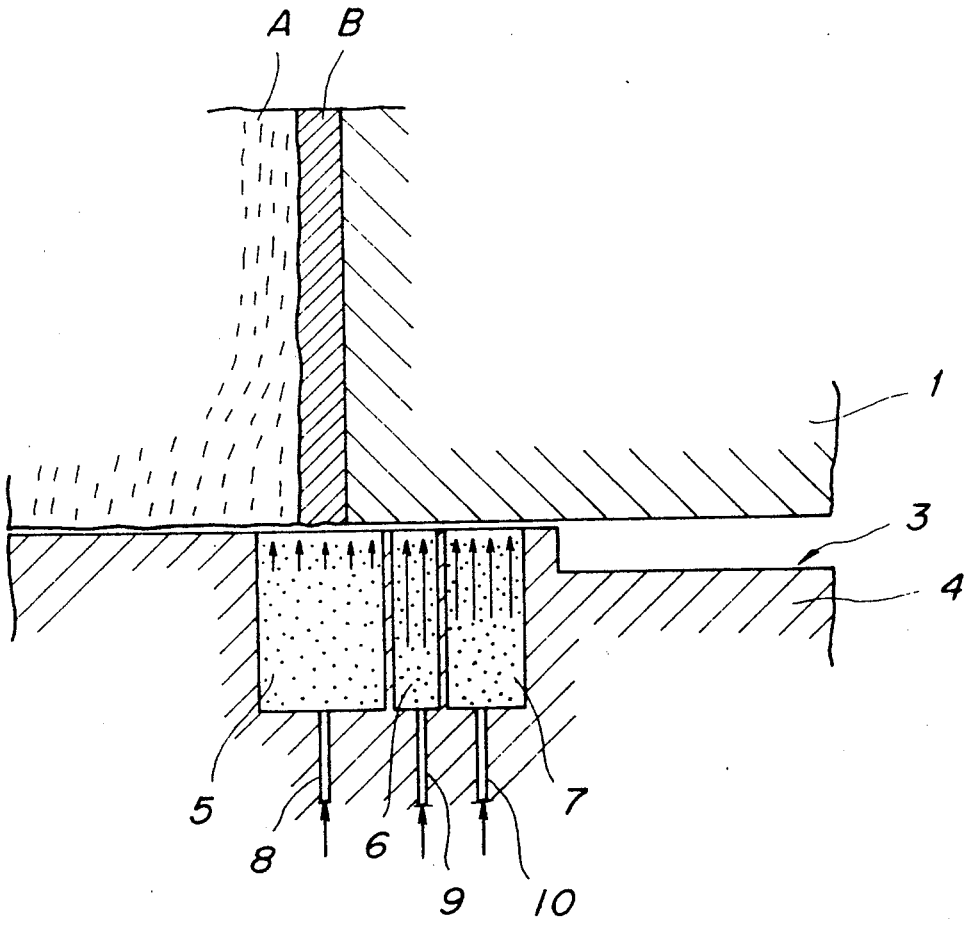
FIG. 3 is a section taken on line III—III in FIG. 2.

Referring to FIGS. 1 to 3, numeral I designates a pair of mold rolls 1 arranged in parallel relation to each other. At opposite ends of the pair of mold rolls 1 there are disposed side weirs 3 in abutment against the end surfaces of the rolls 1 to define a molten-metal reservoir 2 above the gap between the rolls 1.

Each of the side gates 3 has an inverted trapezoidal weir body 4 constructed of a refractory material, first porous members 5 of a predetermined Width disposed on roll 1 side surface of the weir body 4 and extending along the border between molten metal A and each roll 1 in an arcuate pattern, second porous members 6 similarly disposed on the roll side surface of the weir body 4 and extending along the concave side arc of the first porous members 5, and sealing porous members 7 similarly disposed on the roll side surface of the weir body 4 and extending along the concave side arc of the second porous members 6. These porous members 5, 6, 7 are preferably formed of $Al_2O_3$. The first and sealing porous members 5, 7 may be formed of SiC or graphite. Further, as FIG. 3 shows, each side weir 3 is provided with a first oil supply passage 8 connected to each of the first porous members 5 for jetting a stream of oil at a predetermined pressure through the roll side surface thereof, a gas supply passage 9 connected to each of the second porous members 6 for jetting a stream of inert gas at a pressure higher than that of the oil through the roll side surface thereof, and a second oil supply passage 10 connected to each of the sealing porous members 7 for jetting a stream of oil at a predetermined pressure through the roll side surface thereof.

For the above mentioned oil and gas supply, the following are used under such pressures and in such amounts a respectively shown below.

| | Kind | Pressure | Amount |
|---|---|---|---|
| First porous member | colza oil | 1.5 kg f/cm$^2$ | 20 cc/h · cm |
| Second porous member | Ar gas | 3 kg f/cm$^2$ | 1000 cc/h |
| Sealing porous member | colsa oil | 2 kg f/cm$^2$ | 25 cc/h · cm |

When continuous casting is to be carried out, oil and gas are supplied to the corresponding porous members 5, 6, 7 under the conditions specified in the Table. Thereupon, as FIG. 3 shows, a stream of oil is jetted out at the predetermined pressure through each of the first porous members 5 toward the boundaries between the rolls 1 and the molten metal A, whereby molten metal A can be accurately prevented from leaking through or entry into any clearance adjacent the ends of the rolls 1. The oil is prevented from flowing outward by a stream of gas jetting through the adjacent second porous member 6. The gas is in turn sealed off by a stream of oil jetting through each of the sealing porous members 7.

The oil jetting through the first porous members 5 is carbonized under the high temperature of the molten metal, thus serving to act as a buffer medium between the rolls and each side weir 3 and also to act as a lubricant between each side weir 3 and a solidified shell B thereby to protect the shell B as it is just produced.

Even if the clearance between the rolls 1 and each side weir 3 becomes momentarily widened because of some roughness of the surface of the roll 1 and/or the roll side surface of the side weirs 3 or because of a slight inclination of the rolls 1, the pressure of the oil is kept in order by the pressure of gas jetting through the second porous members 6. This fact also ensures that any leak through or entry into such clearance of molten metal can be well prevented.

The oil from the sealing porous member 7 serves to reduce possible slide resistance between the rolls 1 and each side weir 3 and thereby to restrain fluctuations in the load torque of the rolls 1, in addition its function to prevent gas leaks.

Average filling degrees for porous member 5, 6, 7 are, for example, as follows: 97% for first porous member 5; 95% for second porous member 6; and 98.5% for sealing porous member 7. The porosity of porous members 5, 6, 7 each is set so that it varies gradually. That is, the porosity is higher at the oil/gas supply side and lower at the jetting side.

Second Embodiment

Figure 4:
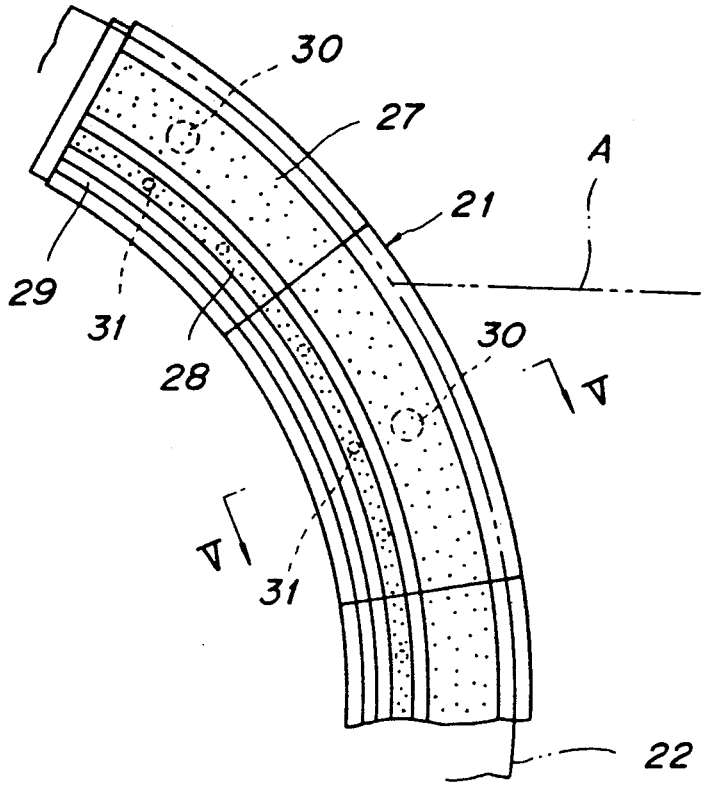
FIG. 4 is a fragmentary front view showing a second embodiment of the apparatus for sealing molten metal according to the invention.
Figure 5:
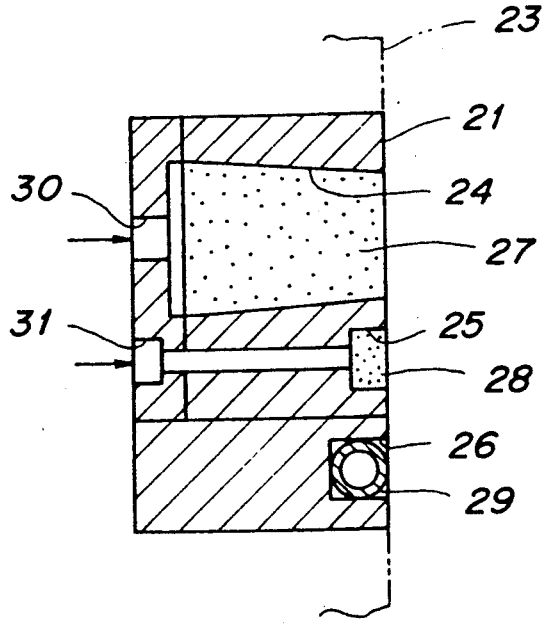
FIG 5 is a section taken on line V—V in FIG. 4.

In FIGS. 4 and 5, numeral 21 designates an arcuate embedded member formed of, for example, an extra-hard ceramic material which is embedded in a surface portion of a weir body 23 so as to be positioned across the border between molten metal A and rolls 22. In the embedded member 21, there are formed, in order of proximity to the surface of the rolls, a first groove 24, a second groove 28, and a third groove 26. The first groove 24 has a first porous member 27 fitted therein: the second groove 25 has a second porous member 28 fitted therein: and the third groove 26 has packing 29 fitted therein. The embedded member 21 is formed with holes 30, 31 for supplying oil and inert gas (such as Ar gas or $N_2$ gas) to the first porous member 27 and second porous member 28 respectively, such holes 30, 31 being provided in pluralities in spaced apart relation. For reasons of manufacturing convenience, members 21, 27, 28 are longitudinally divide in a plurality of segments.

According to such arrangement as well, oil of the predetermined pressure jets out through the first porous member 27 to prevent any leak of molten metal, and gas jets out through the second porous member 28 to prevent oil run-off; and further the gas is sealed by the packing 29.

Figure 6:
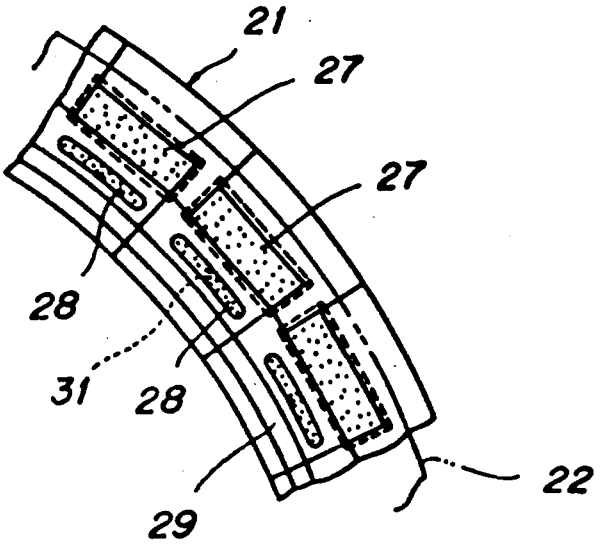
FIGS. 6 and 7 are fragmentary front views showing modified forms of the embodiment shown in FIG. 4.
Figure 7:
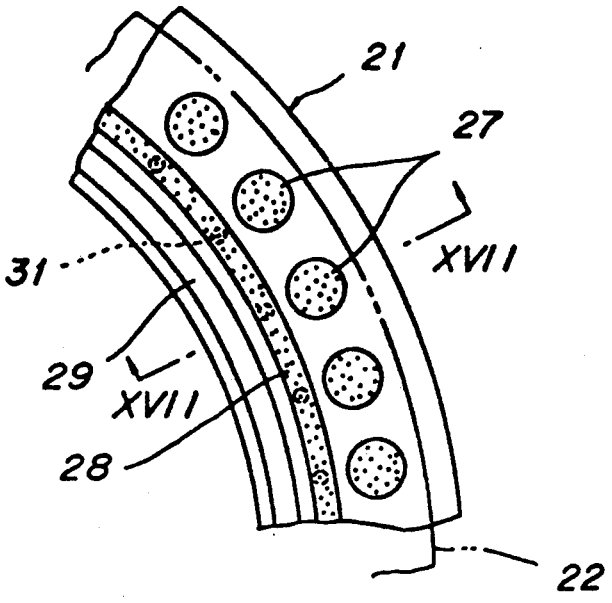
Figure 17:
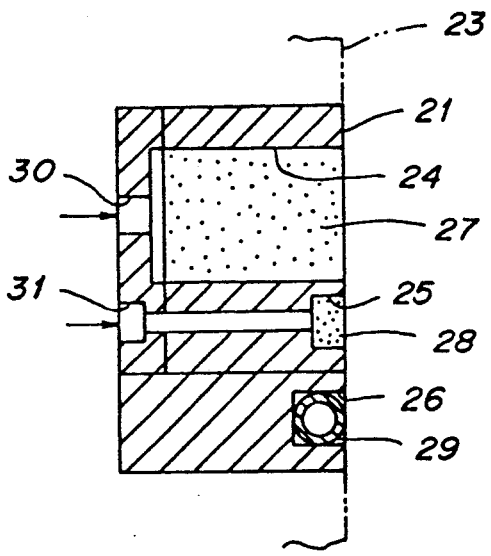
FIGS. 17 and 18 are sections taken along the line XVII—XVII in FIG. 7.
Figure 18:
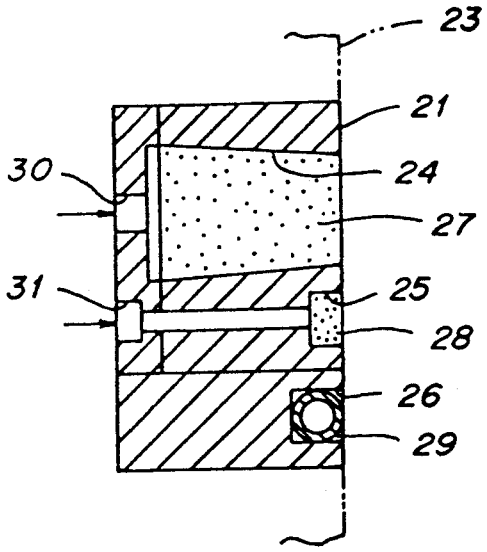

In the embodiment shown in FIGS. 4 and 5, the first porous member 27 is formed in an elongate arcuate pattern. However, as FIG. 6 shows, for example, the first and second porous member 27, 28 each may be divided into a plurality of segments longitudinally arranged in spaced apart relation. In another alternative, as FIG. 7 shows, a plurality of porous members 27 of either columnar configuration as shown in FIG. 17 or conical configuration as shown in FIG. 18 may be provided Which are arranged in spaced apart relation.

Third Embodiment

Figure 8:
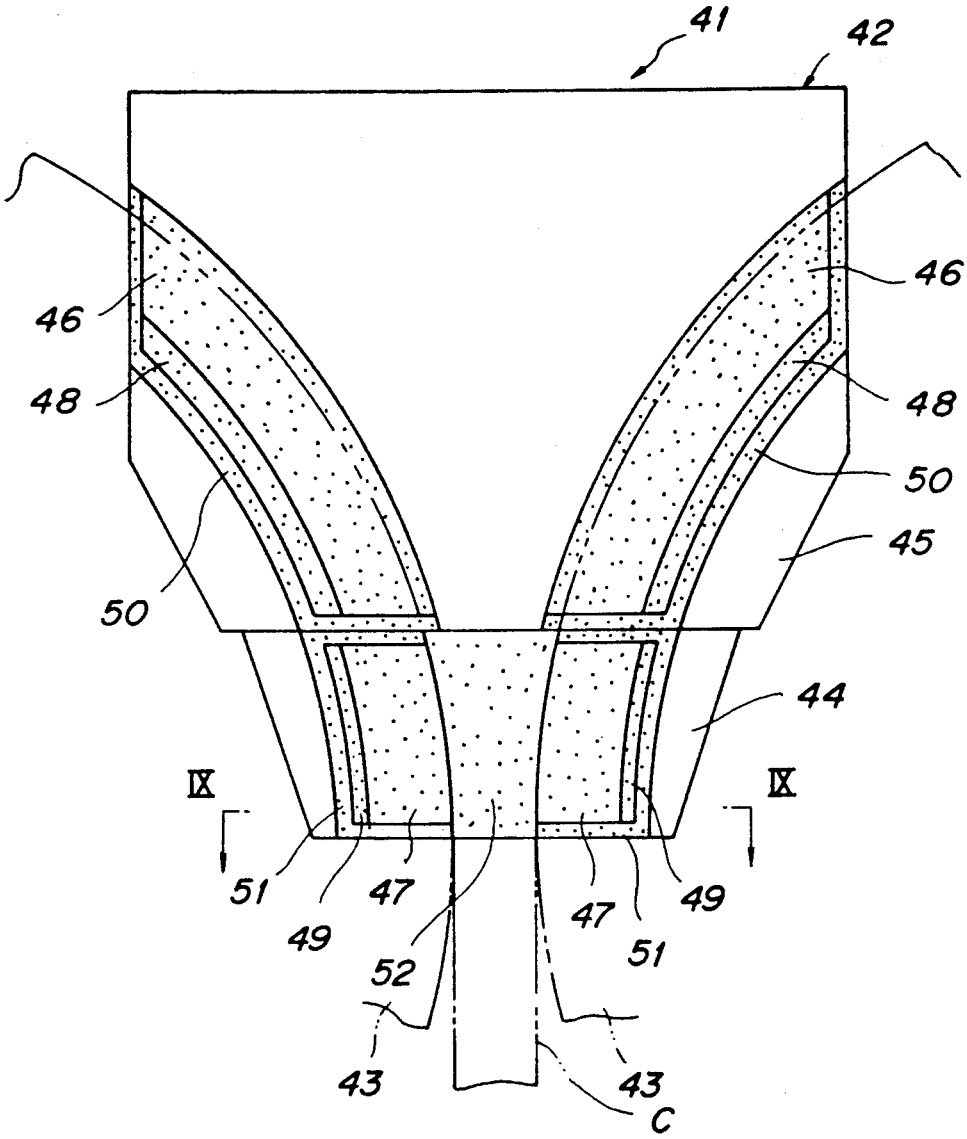
FIG. 8 is a fragmentary front view showing a third embodiment of the apparatus for sealing molten metal according to the invention.
Figure 9:
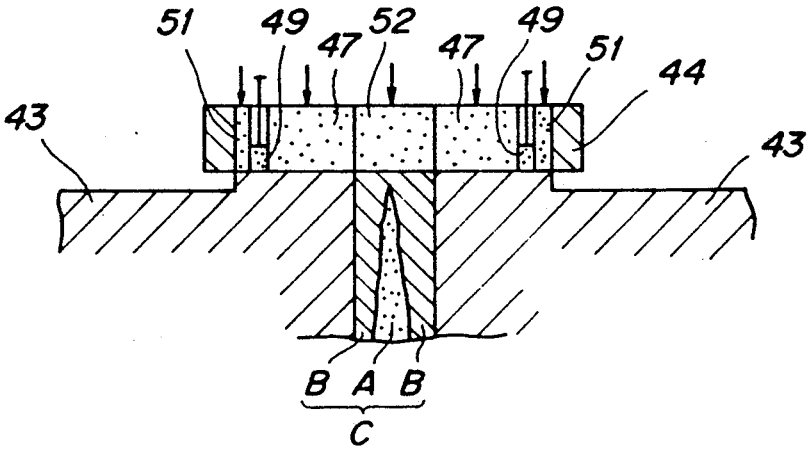
FIG. 9 is a section taken on line IX—IX in FIG. 8.

Referring to FIGS. 8 and 9, a weir body 42 of a side weir 41 consists of a nose portion 44 of a predetermined height above a level adjacent the location at which rolls 43 are most closely spaced, and an upper weir body 45 positioned directly above the nose portion 44. The upper weir body 45 and the nose portion 44 are respectively provided with first porous members 46 and 47 for jetting out oil for preventing any leakage of the molten metal; with second porous members 48 and 49 for jetting out gas for preventing any outward flow of the oil; and also with sealing porous members 50, 51 for jetting out oil for sealing the gas. Between the pair of the first porous members 47, 47 of the nose portion 44 are provided a third porous member 52 of inverted trapezoidal shape for jetting out a high-pressure oil (e.g., of 30 kg/cm$^2$) toward the molten metal A. Further, there ia provided a high-pressure oil supply passage (not shown) for supplying high-pressure oil to the third porous member 52.

By jetting out high-pressure oil from the third porous member 52 of the nose portion 14 toward the molten metal A, it is possible to prevent seizing of cast metal C which may otherwise occur at a junction of solidified shells B, and also to reduce any slide resistance against the cast metal and/or prevent any excessive bulging thereof.

Fourth Embodiment

Figure 10:
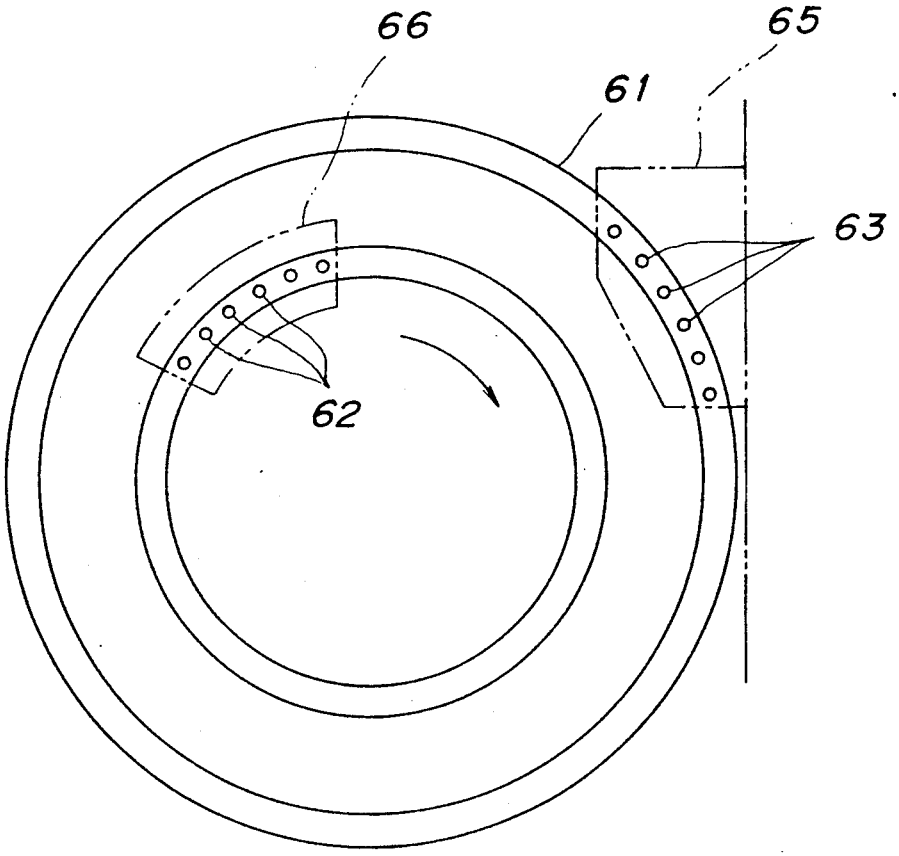
FIG. 10 is an end view of a roll in a fourth embodiment of the apparatus for sealing molten metal according to the invention.
Figure 11:
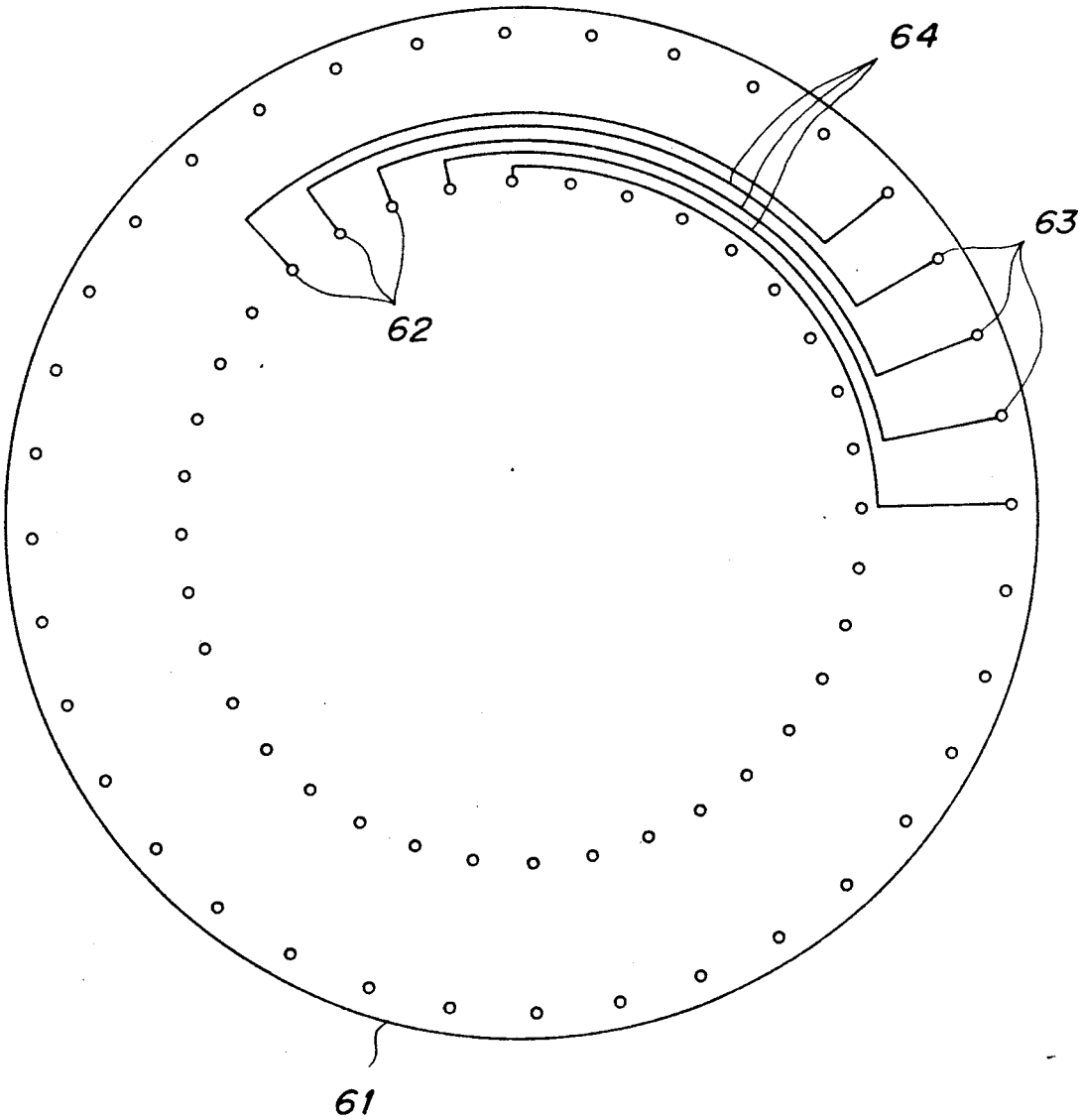
FIG. 11 is an enlarged detail end view of the roll shown in FIG. 10.

In this embodiment a stream of oil for preventing leakage of molten-metal jets out from the roll side, whereas in the first to third embodiments such oil jets out from the weir side. Referring to FIGS. 10 and 11, each roll 61 is formed on its each end with a plurality of oil supply holes 62 opening in spaced apart relation in a redially inner portion and also with a corresponding number of oil jetting holes 63 opening in a radially outer portion. Further, as FIG. 11 illustrates, each pair of holes 62, 63 spaced apart a specified angle communicate each other by means of a communicating passage 64 (in FIG. 11, only five of such passage are shown, but needless to say, all such pairs of holes are individually interconnected in the like manner). In order to ensure that oil is constantly supplied to the oil jetting holes 63 opposite to a weir body 65, a supplying member 66 is disposed on a side portion of each roll 61 for supplying oil to the corresponding number of oil supply holes 62. Of course, this arrangement exhibits the same performance as the foregoing embodiments.

Fifth Embodiment

Figure 12:
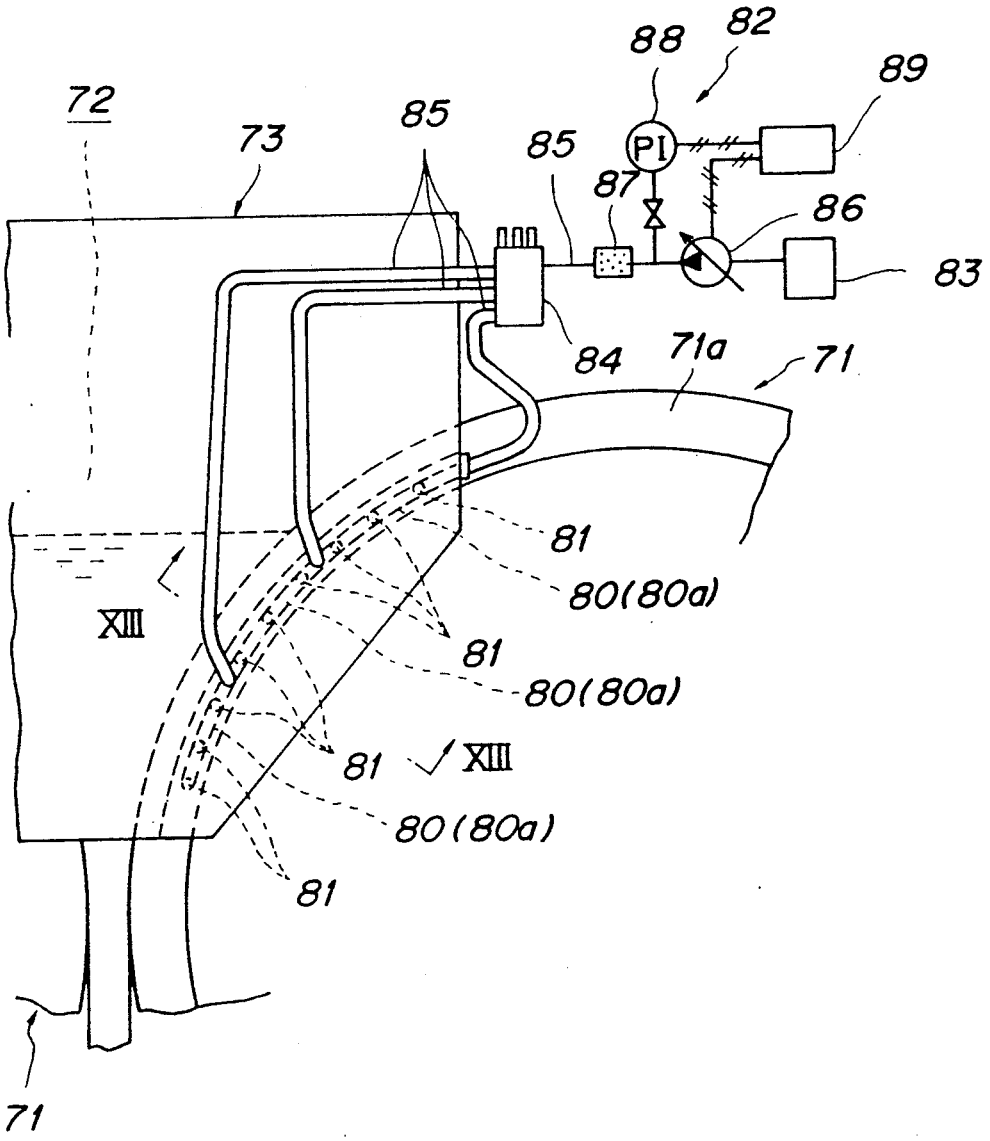
FIG. 12 is fragmentary front view showing a fifth embodiment of the apparatus for sealing molten metal according to the invention.
Figure 13:
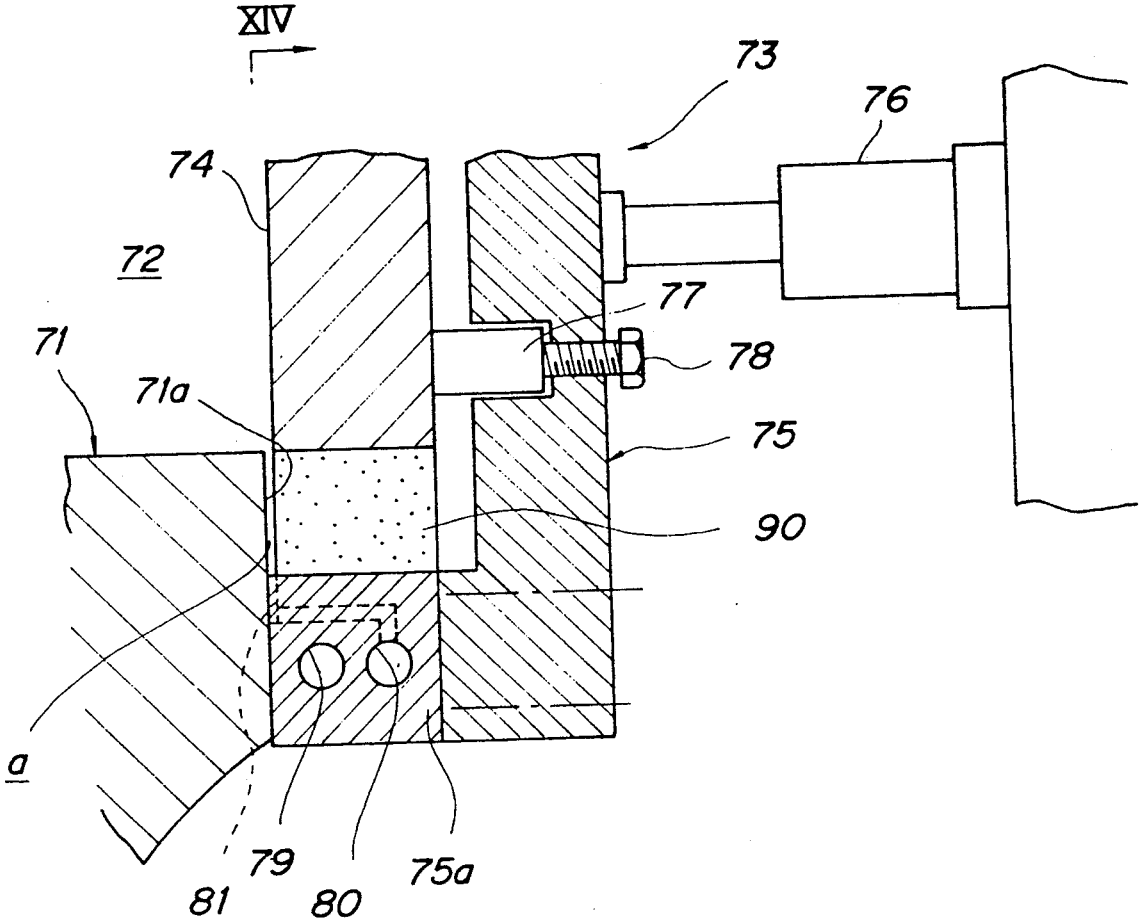
FIG. 13 is a section taken of line XIII—XIII in FIG. 12.
Figure 14:
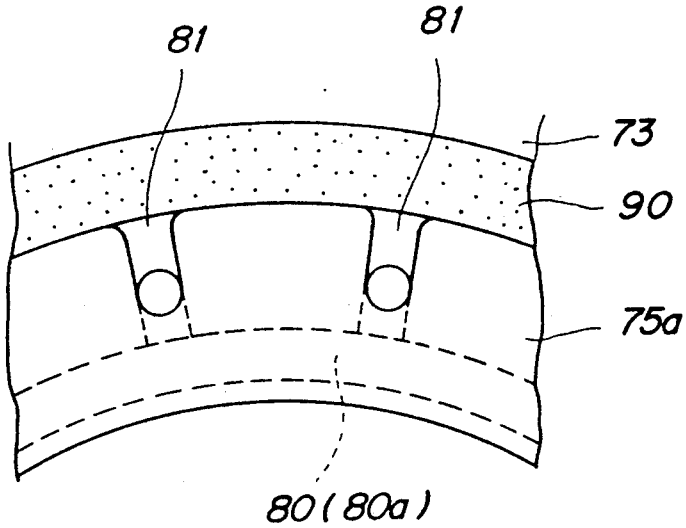
FIG. 14 is a section taken along line XIV—XIV in FIG. 13.

Referring to FIGS. 12 to 14, each side weir 73 as a constituent for forming a molten-metal reservoir 72 above the gap between rolls 71 comprises a Weir body 74 of generally inverted trapezoidal shape which is constructed of a refractory material, a support member 75 of L-shaped sectional configuration for supporting the weir body 74 from the outer side thereof, and a pressing jack 76 for urging the support member 75 toward the end surface of the rolls 71. The weir body 74 is supported by a bent lower end portion 75*a* of the support member 75 so that a predetermined clearance a (e.g., within the limits of 0.01 to 0.2 mm) is defined between it and an outer peripheral end of each roll 71 (which projects more laterally than a median portion). The clearance a can be adjusted by means of a push bolt 78 through a push piece 77 disposed between the weir body 74 and the support member 75. The bent portion 75*a* of the support member 75 is made of metal (or may be made of a ceramic material having good mechanical strength) in arcuate shape and is formed in its interior with a cooling water passage 79 and a sealing medium supply passage 80. The sealing medium supply passage 80 is circumferentially divided into, for example, three parts, and the bent portion 75*a* is formed with deliverey ports si in, for example, three each in number for supplying sealing medium from the divided supply passages 80*a* to the clearance a.

A device 82 for supplying sealing medium is connected to each of the divided supply passages 80*a*. The device 82 comprises a sealing medium storage tank 83, a connection pipe 85 (which branches into three) for connecting the storage tank 83 to the sealing medium supply passage 80, that is, the divided supply passages 80*a*, with a distributor 84 interposed on the way, a variable deliverey pump 86 interposed on the way along the connection pipe 85, a pressurizing member 87 formed of a metallic porous member which is disposed on the pipe 85 between the distributor 84 and the pump 86, and a control unit 89 for regulating the delivery rate and delivery pressure of the pump 86 through a pressure gauge 88 intereposed on the connection pipe 85 between the pressurizing member 87 and the pump 86.

For the sealing medium, a material whose viscosity is within the ASTM consistency range of 200 to 400 is used. For example, a mixture, which has some fluidity, of a solid powdery refractory material (of a softening temperature of not lower than 800° C.) and an organic liquid may be used, such that a powdery refractory material having a particle diameter of the order of 1 to 20 μm is contained in the organic liquid. For the organic liquid material, one which volatilizes in a temperature range of 120° to 700° C. into small amounts of carbides, for example, colza oil is used. For the powdery refractory material, carbide type, aluminum oxide type, or nitride type compounds (such as BN) are used.

More particularly, for the solid powdery refractory material, $SiO_2$ (molten silica) having a particle size of the order of 0.4 to 20 μm (average 1 to 2 μm) is used, and the powdery refractory material is mixed with colza oil, a solvent, in such a way that a mixture ratio of 5 to 50% (for example, 25%) by weight is obtained. Further, the material of the refractory powder and the viscosity of the solvent are adjusted to obtain a liquid of the above mentioned ASTM consistency of about 200 to 400 which can be fed under pressure. For the solid powdery refractory material, it is required that the material should not be melted at the prevailing temperature (800° C. max) in the clearance a.

The division of the sealing medium supply passage 80 into three parts is intended to prevent fluctuations in the amount of delivery for individual delivery ports 81. The required amount of the sealing medium varies according to the casting rate, that is, the casting rate, that is, the higher the casting rate, the greater is the amount of the sealing medium consumed. Further, the amount of sealing medium delivered with the rotation of the rolls 71 is greater at a location nearer to the cast-metal outlet. Therefore, it is arranged that the amount of delivery can be adjusted, for example, by distributor 84 according to the site of each divided supply passage 80*a*.

Since the organic liquid is volatile, a porous member 90 is disposed in the weir body 74 at a site corresponding to a roll end 71*a* adjacent the outer periphery of each roll 71 for the purpose of discharging volatilized gas.

Figure 15:
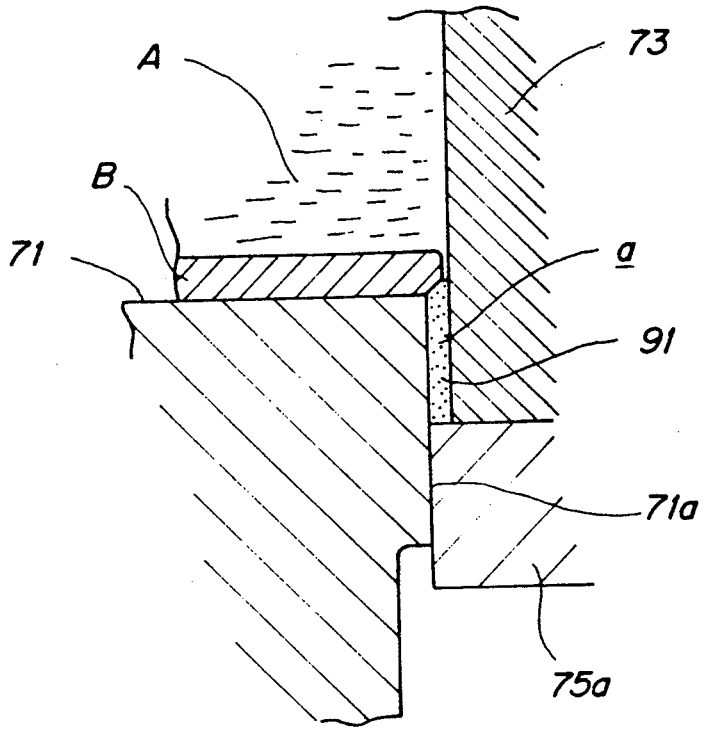
FIGS. 15 and 16 are fragmentary sectional views of the apparatus shown in FIG. 12 when sealing mediums are supplied to the apparatus.

During casting operation, as FIG. 15 shows, sealing medium 91 is supplied by the device 82 into the clearance a between the roll end 71*a* and the weir body 74. Thus, entry of molten metal A and solidified shell B into the clearance a is prevented. The temperature of the sealing medium 91 rises under the heat from the molten metal, but carbides produced with the temperature rise have a lubricating function; and accordingly the weir body 74 is protected against frictional wear. Furthermore, a proportion of such carbides enters the site of mechanical sliding between the roll end 71*a* and the side weir 74, that is, the contact surface between the roll end 71*a* and the bent portion of the support member 75, to produce a thin film, and accordingly these members are prevented from wear due to friction between them. With its temperature rise, the sealing medium will remain in the form of a powdery refractory material, but such material will exit outward together with solidified shell. Therefore, fresh sealing medium 91 is constantly supplied into the clearance a to enable accurate sealing.

Figure 16:
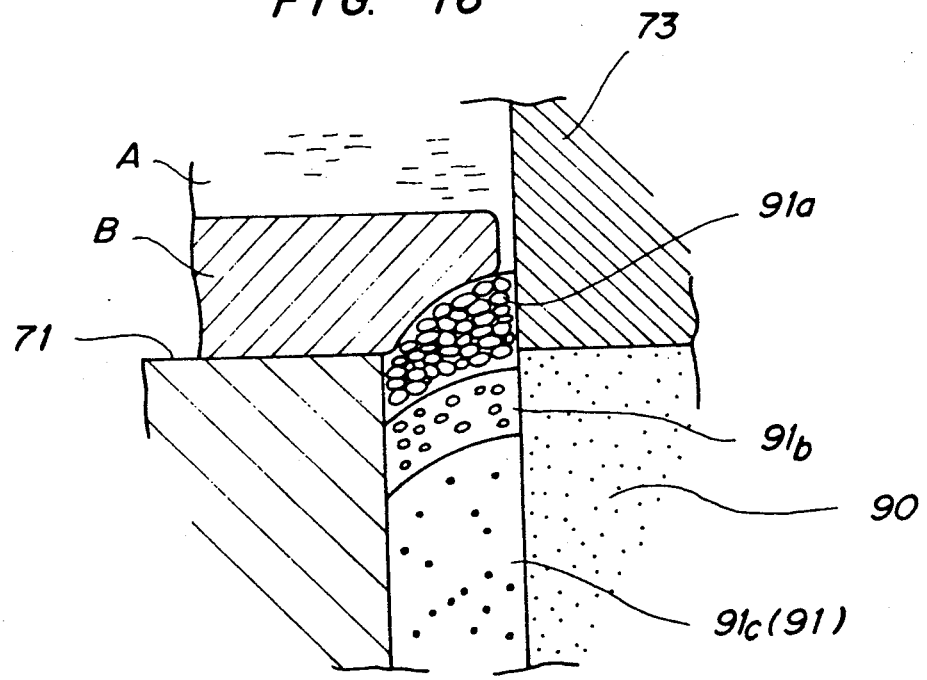

FIG. 16 shows the condition of sealing medium 91. In FIG. 16, reference numeral 91*a* designates a residual powdery refractory material; 91*b* designates a sealing medium in the course of volatilization; and 91*c* designates a sealing medium as supplied through the delivery port 81.

Control of the supply of sealing medium 91 is important. If the supply is excessive, some sealing medium may enter into the molten metal. Conversely, if the supply is too small, no satisfactory seal effect can be obtained. The supply of sealing medium is controlled by using the rate of casting as a factor, but the consumption of sealing medium fluctuates according to temperatures and solidified shell condition. In order to ensure adequate supply, therefore, supply is controlled by supply pressure via the pressure gauge 88 interposed at a suitable location on the connection pipe 85. The supply pressure required for sealing medium supply is in a low pressure range of about 0.0 to 0.2 $kg/cm^2$ corresponding to molten-metal static pressure. Therefore, the supply pressure for sealing medium is difficult to control. For this reason, it is arranged to adjust the supply pressure by the pressure member 87 interposed on the connection pipe 85 to a pressure of, for example, not lower than 5 $kg/cm^2$ which is generally easy to control. Pressure measurement is carried out ahead of the pressure member 87 in order to control the discharge pressure of the pump 86 or discharge rate.

Gas issuing from the organic liquid of the sealing medium is discharged outward from the porous member 90 disposed in a lower portion of the weir body 74.

Now, an example will be given.

500 kg of a molten steel corresponding to SUS 304 (JIS) was cast at the rate of 30 m/min to obtain 70 m of a slab of 200 mm in width and 4.5 mm in thickness. It is noted that water-cooled rolls made of stainless steel were used.

Observations are as follows.

(1) Where the arrangement according to the invention was employed:

No frictional wear occurred at the sliding portion, i.e., alumina-based porous member, of each side weir, or at any roll end.

(2) Where the prior-art arrangement was employed:

A frictional wear of about 0.3 to 0.5 mm occurred at a portion of each side weir made of $SiO_2$ which was subject to slide friction with each roll end, and a scratch of about 0.3 mm in depth occurred on the roll end surface, which required remachining.

In the above description, the sealing medium is in the form of a mixture of a powdery refractory material and an organic liquid. Alternatively, however, a mixture of, for example, a powdery plastic material and an organic liquid may be used as sealing medium, in which case the powdery plastic material will remain as carbides which serve to provide improved lubricating function.

In the above description, each side weir has a mechanical slide portion which is slidable relative to the rolls, that is, the roll ends and the bent portion of the support member are relatively slidable. Alternatively, however, such mechanically slidable portion may be dispensed with by arranging to provide a clearance all over between the side weirs and the rolls by a side weir position control device.

In the above description, sealing medium is supplied over full range of the slide portion of each side weir relative to the roll ends. Alternatively, sealing medium may be supplied over a minimum necessary range only. That is, a starting end of sealing medium supply into the clearance a may be at a level slightly above the surface of the molten metal.

Heating means may be provided on the weir side, for example, to forcedly heat the organic liquid solvent of the sealing medium supplied into the clearance a to allow it to volatilize.

What is claimed is:

1. A method for sealing molten metal for use in a twin-roll type continuous casting apparatus for preventing molten metal from entry into a clearance between a pair of mold rolls and side weirs disposed at opposite ends of the pair of mold rolls to define a molten metal reservoir above the gap between the mold rolls, characterized by providing a sealing medium, and introducing said sealing medium at the inner side of the side weirs in the vicinity of the border between the molten metal and each of the mold rolls, wherein the sealing medium is oil, and including the step of jetting out the oil at a predetermined pressure.

2. A method for sealing molten metal for use in a twin-roll type continuous casting apparatus for preventing molten metal from entry into a clearance between a pair of mold rolls and side weirs disposed at opposite ends of the pair of mold rolls to define a molten metal reservoir above the gap between the mold rolls, characterized by providing a sealing medium, and introducing said sealing medium at the inner side of the side weirs in the vicinity of the border between the molten metal and each of the mold rolls, wherein the sealing medium is a mixture of a powdery refractory material and an organic liquid, and the sealing medium has some fluidity.

3. A method for sealing molten metal for use in a twin-roll type continuous casting apparatus for preventing molten metal from entry into a clearance between a pair of mold rolls and side weirs disposed at opposite ends of the pair of mold rolls to define a molten metal reservoir above the gap between the mold rolls, characterized by providing a sealing medium, and introducing said sealing medium at the inner side of the side weirs in the vicinity of the border between the molten metal and each of the mold rolls, wherein the sealing medium is a mixture of a powdery plastic material and an organic compound, and the sealing medium has some fluidity.

4. An apparatus for sealing molten metal in a twin-roll type continuous casting apparatus for preventing molten metal from entry into a clearance between a pair of mold rolls and side weirs disposed at opposite ends of the pair of mold rolls to define a molten metal reservoir above the gap between the mold rolls, the apparatus comprising:

means for supplying a sealing medium at the inner side of the side weirs in the vicinity of the border between the molten metal and each of the mold rolls, wherein each of said side weirs comprises;

a weir body;

first porous members of a predetermined width disposed on the mold roll side surface of the weir body and extending along the border between molten metal and each mold roll in an arcuate pattern, second porous members extending along the concave side of the first porous members in an arcuate pattern, sealing means extending along the concave side of the second porous members in an arcuate pattern, oil supply passage means connected to each of the first porous members for jetting out oil at a predetermined pressure through the mold roll side surface of the first porous member, and gas supply passage means connected to each of the second porous members for jetting out an inert gas at a pressure higher than the oil through the mold roll side surface of the second porous member.

5. An apparatus for sealing molten metal as set forth in claim 4, wherein the sealing means comprises a sealing porous member, and an oil supply passage connected to the sealing porous member for jetting out oil at a predetermined pressure through the mold roll side surface of the sealing porous member.

6. An apparatus for sealing molten metal as set forth in claim 4, wherein the sealing means is formed of packing.

7. An apparatus for sealing molten metal as set forth in claim 4, wherein the first and second porous members are each divided into a plurality of segments in the longitudinal direction thereof.

8. An apparatus for sealing molten metal as set forth in claim 7, wherein the split portions of each of the first and second porous members are arranged in succession in the longitudinal direction thereof.

9. An apparatus for sealing molten metal as set forth in claim 7, wherein the split portions of each of the first and second porous members are arranged in spaced apart relation in the longitudinal direction thereof.

10. An apparatus for sealing molten metal as set forth in claim 9, wherein the first porous members are column-shaped.

11. An apparatus for sealing molten metal as set forth in claim 4, wherein:

the weir body has a nose portion of a predetermined height above a level adjacent the location at which the mold rolls are most closely spaced, said molten-metal sealing device further comprising:

a third porous member disposed on the surface of said nose portion between the first porous members and facing the molten reservoir, and high pressure oil supply pipe means connected to the third porous member for jetting out high-pressure oil through the molten-metal reservoir side surface of the third porous member.

12. An apparatus for sealing molten metal as set forth in claim 9, wherein the first porous members are cone-shaped.

13. An apparatus for sealing molten metal in a twin-roll type continuous casting apparatus for preventing molten metal from entry into a clearance between a pair of mold rolls and side weirs disposed at opposite ends of the pair of mold rolls to define a molten metal reservoir above the gap between the mold rolls, the apparatus comprising:

means for supplying a sealing medium at the inner side of the side weirs in the vicinity of the border between the molten metal and each of the mold rolls, said sealing medium supply means being provided on the mold-roll side, a plurality of oil jetting holes formed on each mold-roll end side and opening in spaced apart relation in a radially outer portion of the roll end so that said oil jetting holes come into faced relation to the side weir as the mold roll rotates, a plurality of oil supply holes formed on the mold-roll end side in a radially inner portion of the roll end, a communicating passage provided in the mold roll for communicating each of the oil supply holes with a corresponding oil jetting hole, and means for supplying oil into oil supply holes communicating individually with oil jetting holes which have come into faced relation to the weir body.

14. An apparatus for sealing molten metal as set forth in claim 13, wherein:

each communicating passage is able to communicate one of the oil supply holes and one of the oil jetting holes which are circumferentially spaced apart over a predetermined angle, and the oil supply means is circumferentially spaced apart from the side weir over said predetermined angle.

15. An apparatus for sealing molten metal in a twin-roll type continuous casting apparatus for preventing molten metal from entry into a clearance between a pair of mold rolls and side weirs disposed at opposite ends of the pair of mold rolls to define a molten metal reservoir above the gap between the mold rolls, the apparatus comprising:

means for supplying a sealing medium at the inner side of the side weirs in the vicinity of the border between the molten metal and each of the mold rolls, wherein the sealing medium is a mixture of a powdery material and an organic liquid, and the sealing medium has some fluidity.

16. An apparatus for sealing molten metal as set forth in claim 15, further comprising:

a clearance defined between one end of each mold roll and the side weir, a sealing medium, supply passage provided in the mold roll, and delivery ports provided in the mold roll which are able to supply sealing medium into the clearance through the sealing medium supply passage.

17. An apparatus for sealing molten metal as set forth in claim 16, wherein:

the sealing medium supply passage extends in an arcuate pattern along the end surface of the mold roll and is divided into a plurality of segments in the longitudinal direction, and the delivery ports are provided in plurality for each segment of the sealing medium supply passage in the mold roll.

18. An apparatus for sealing molten metal as set forth in claim 17, wherein there is provided means for regulating the delivery of sealing medium from the delivery ports for each segment of the sealing medium supply passage.

19. An apparatus for sealing molten metal as set forth in claim 15, further comprising a porous member for discharging any gas issuing from the sealing medium supplied, said porous member being disposed on the side weir which faces to the roll end.

20. An apparatus for sealing molten metal as set forth in claim 15, wherein said powdery material is a refractory material.

21. An apparatus for sealing molten metal as set forth in claim 15, wherein said powdery material is a plastic material.

* * * * *